US005440857A

United States Patent [19]

Shanok et al.

[11] Patent Number: 5,440,857

[45] Date of Patent: Aug. 15, 1995

[54] ENDLESS EDGE TRIM FABRICATED FROM AN EXTRUDED PROFILE

[75] Inventors: William Shanok, New York, N.Y.; Harold Waldman, Yardley, Pa.; Salvator Cigna, Bound Brook, N.J.; Valery Safronchik, Staten Island, N.Y.; Victor Shanok, New York, N.Y.; Jesse P. Shanok, New York, N.Y.

[73] Assignee: Silvatrim Associates, South Plainfield, N.J.

[21] Appl. No.: 265,915

[22] Filed: Jun. 27, 1994

[51] Int. Cl.[6] ..... E04F 19/00; E04F 19/02

[52] U.S. Cl. ..... 52/716.8; 52/717.03; 52/717.04; 52/717.05; 108/27; 312/140.3

[58] Field of Search ..... 52/783, 813, 821, 822, 52/823, 716.8, 717.03, 717.04, 717.05, 717.06; 108/27, 157; 312/140.1, 140.3

[56] References Cited

U.S. PATENT DOCUMENTS

| | | | |
|---|---|---|---|
| 2,348,658 | 5/1944 | Slaughter | 52/823 X |
| 2,729,142 | 1/1956 | Beach, Jr. | 52/823 X |
| 2,743,980 | 5/1956 | Hobbs | 52/783 |
| 2,846,283 | 8/1958 | Pasewalk | 52/783 |
| 3,706,173 | 12/1972 | Taylor | 52/823 X |
| 3,748,799 | 7/1973 | Tough et al. | 52/823 X |
| 4,503,780 | 3/1985 | Apissomian | 52/813 X |

*Primary Examiner*—Carl D. Friedman
*Assistant Examiner*—Yvonne Horton-Richardson
*Attorney, Agent, or Firm*—Goodman & Teitelbaum

[57] ABSTRACT

An endless edge trim, which can be snapped onto and secured to a peripheral edge of an article, being fabricated from a longitudinally extending extruded profile having a uniform cross section, with opposite ends of the profile being secured together, preferably by a sonic welded gusset. The endless edge trim includes a longitudinally extending body member having a predetermined length, the body member having a vertical body portion, a top flange portion, and a bottom flange portion. The top and bottom flange portions are spaced apart a predetermined distance to provide a tension therebetween for locking the endless edge trim on the peripheral edge of the article. The endless edge trim has a hoop, ring or oval configuration, where notches can be formed therein to provide for a rectangular frame shaped configuration. In a modified form, the lower part of the body portion provides a seat for positioning the endless edge trim on the article prior to the snap-on engagement of the endless edge trim onto the peripheral edge of the article.

20 Claims, 2 Drawing Sheets

ENDLESS EDGE TRIM FABRICATED FROM AN EXTRUDED PROFILE

BACKGROUND OF THE INVENTION

The invention relates to an endless edge trim for locking onto the edges of a round, oval, square or rectangular shaped article, such as tables, mirrors, photoframes, lighting fixtures and the like, and more particularly, to an endless edge trim fabricated from an extruded profile having the opposite ends secured together to form a hoop, ring, oval or rectangular frame shape for snapping onto the peripheral edge of the article to provide a secure engagement therebetween.

At the present time, the peripheral edges of round or oval shaped dinette and cocktail tables are often provided with a film or painted veneer, particularly when the table is fabricated from an inexpensive wood or wood substitutes. The edge decorating and finishing most often includes routing a T-shaped slot in the edge of the table top, and inserting an extruded molding, which is often pliable, into the slot, where the molding is either glued in place, held in by a force-fit engagement, or stapled to the end surface of the table top.

The edges of mirrors, photoframes and the like are usually framed by an injection molded plastic material disposed therearound, which involves a high tooling cost, or is framed by fabricated metal parts, which also involves a similar high tooling cost, in addition to having a limited number of finishing options. Square or rectangular picture frames are usually assembled with one side of the frame opened so that the picture frame glass can be inserted therein, after which the opened frame side is closed onto the picture frame glass and secured thereto, such as by glue.

U.S. Pat. No. 3,060,606 discloses a rectangular shaped plastic picture frame which resiliently grips onto the glass and picture. U.S. Pat. No. 3,142,550 discloses a rectangular .shaped plastic filter frame which hingedly grips onto the filter. U.S. Pat. No. 5,253,439 discloses a picture or photoframe fabricated from an extruded L-shaped plastic strip which is notched and bent into a rectangular configuration for securement around the picture frame glass, preferably being secured thereto by a double-sided adhesive tape material, the picture frame having tabs thereon for gripping onto the sides of the picture frame glass.

Prior art lighting fixtures and lamps are also often edge-finished with some type of metal banding, or with an extruded plastic material which is held in place with a finishing clip. Such a finishing clip is frequently unsightly, and adds cost and labor to the assembly thereof.

Accordingly, there is presently a need for an endless edge trim which can be quickly snapped onto the edge of an article at a high assembly rate of speed, which does not require utilization of any adhesive, staple or other means of attachment, that can be easily and inexpensively manufactured and assembled, and that eliminates the costly manufacturing step of slot routing in wood products, that in addition to the advantage of high speed assembly, also provides design versatility and lower overall cost of product.

SUMMARY OF THE INVENTION

It is accordingly an object of the present invention to provide an endless edge trim for mounting on a peripheral edge of an article which avoids the problems and disadvantages of the prior art edge trims.

Another object of the present invention is to provide an endless edge trim fabricated from an extruded profile, where opposite ends of the profile are secured together to provide an endless construction, preferably by a sonic welded gusset.

A further object of the present invention is to provide an endless edge trim which can be easily snapped onto and secured to the peripheral edge of an article.

Still another object of the present invention is to provide a resilient flexible endless edge trim having a vertical body portion, a top flange portion, and a bottom flange portion for positioning around the peripheral edge of an article, where the top and bottom flange portions are spaced apart a predetermined distance to provide a tension therebetween for locking the endless edge trim on the peripheral edge of the article in a secure engagement therewith.

Another object of the present invention is to provide an endless edge trim which has a hoop, ring, oval or rectangular frame shape for snapping onto the peripheral edge of the article.

A further object of the present invention is to provide an endless edge trim having notched means at predetermined intervals so that a rectangularly shaped construction thereof can be formed.

Yet another object of the present invention is to provide an endless edge trim having seat means for the positioning thereof on the article.

Still yet another object of the present invention is to provide an endless edge trim which can be easily and inexpensively manufactured and assembled, and which can be easily and quickly mounted onto a peripheral edge of an article during the assembly thereof.

Briefly, in accordance with the present invention, there is provided an endless edge trim which can be snapped onto and secured to a peripheral edge of an article. The endless edge trim is fabricated from a longitudinally extending extruded profile, with opposite ends of the profile being secured together, preferably by a sonic welded gusset, to provide an endless construction. The endless edge trim includes a longitudinally extending body member having a predetermined length, the body member having a vertical body portion, a top flange portion, and a bottom flange portion. The top and bottom flange portions are spaced apart a predetermined distance to provide a tension therebetween for locking the endless edge trim on the peripheral edge of the article in a secure engagement therebetween. The endless edge trim has a hoop, ring or oval configuration, where notches can be formed therein to provide for a rectangular frame shaped configuration. In a modified form, the lower free part of the body portion provides a seat for positioning the endless edge trim on the article prior to the snap-on engagement of the endless edge trim onto the peripheral edge of the article.

BRIEF DESCRIPTION OF THE DRAWINGS

With the above and additional objects and advantages in view, as will hereinafter appear, this invention comprises the devices, combinations and arrangements of parts hereinafter described by way of example and illustrated in the accompanying drawings of embodiments in which.

In the various figures of the drawings, like reference characters designate like parts.

A DESCRIPTION OF THE PREFERRED EMBODIMENTS

Figure 1:
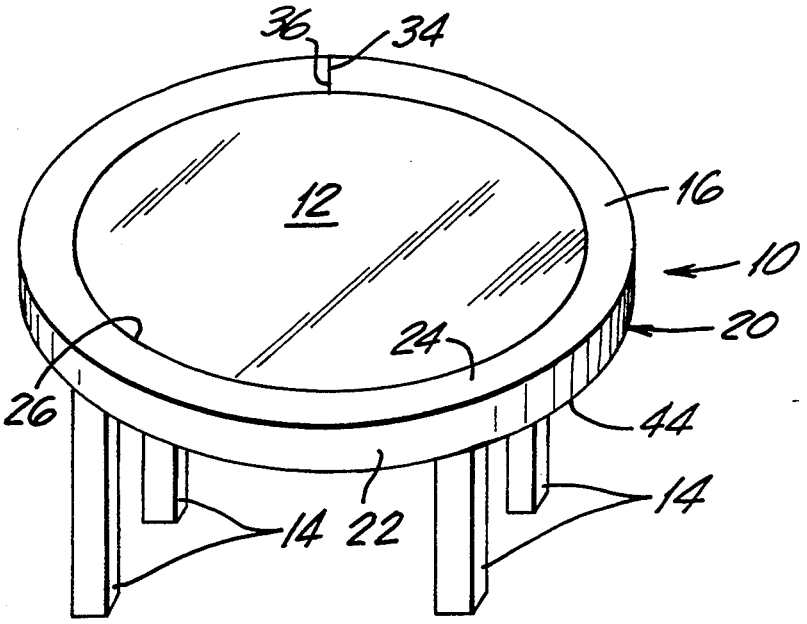
FIG. 1 is a perspective view of a table provided with an endless edge trim in the form of a hoop or ring, fabricated from an extruded profile, locked onto the edge of the round table top in accordance with the present invention.

Referring now to the drawings, FIG. 1 shows a table 10, such as a dinette table, cocktail table and the like, the table 10 including a round table top 12 provided with four legs 14 depending downwardly from an underside of the table top 12 in a conventional manner. An endless edge trim 16 of the present invention, in the form of a hoop or ring, is locked onto the peripheral edge of the round table top 12 in a secure engagement. The table top 12 can be fabricated from any suitable material, such as natural wood, plywood, particle board, glass, glass and .chip board combinations, mirrored glass and the like. Obviously, the legs 14 can also be fabricated from any suitable material well known in the art.

Though FIG. 1 shows the table 10 for illustrative purposes, it is obvious that the endless edge trim 16 of the present invention can be locked onto a peripheral edge of any suitable round or oval article, such as round or oval mirrors, photo or picture frames, lighting fixtures, lamps and the like, in order to provide a decorative finish thereon. Accordingly, other articles having round or oval portions, on which the endless edge trim 16 of the present invention can be installed to improve the decorative appearance thereof, will suggest themselves to those skilled in the art.

Figure 2:
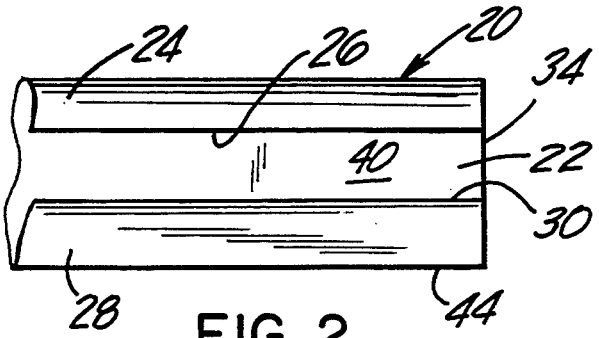
FIG. 2 is a fragmented side elevational view of an extruded plastic strip used in the construction of the endless edge trim.
Figure 3:
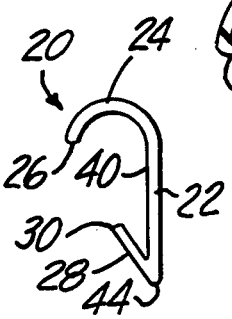
FIG. 3 is an end view of the extruded plastic strip of FIG. 2.

The endless edge trim 16 is constructed from a continuous extruded profile of thermoplastic material, such as acrynitrile butadiene styrene commonly referred to as ABS, forming a "J" or "L" shaped resilient flexible plastic strip 20 having a uniform cross section, as shown in FIGS. 2 and 3. The plastic strip 20 includes a longitudinally extending vertical body portion 22, and an arcuate inwardly curved longitudinally extending top flange portion 24 connected to the longitudinally extending upper end of the body portion 22, the top flange portion 24 having a free end 26. An inwardly inclined, longitudinally extending bottom flange portion 28 is connected to the opposite longitudinally extending lower end of the body portion 22, the bottom flange portion 28 having a free end 30. It is noted, that the plastic strip 20 can be extruded from one material, such as mentioned above, or can be formed by a twin extrusion where a second additional material can be used to form the bottom flange portion 28, such as a soft vinyl material of low durometer so that the bottom flange portion 28 can be easily deformed in its function, as mentioned below.

Figure 4:
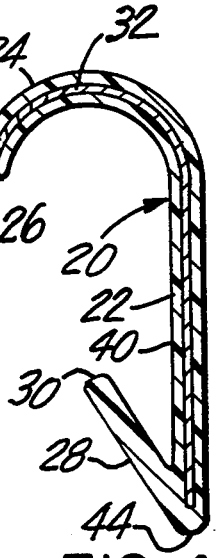
FIG. 4 enlarged cross sectional view of the extruded plastic strip shown in FIG. 2.

As shown in FIG. 4, the plastic strip 20 constitutes a casing which is preferably transparent and encapsulates a metallic strip 32, such encapsulation being well known in the art as disclosed in U.S. Pat. No. 3,730,577 to which reference may be made. The metallic strip 32 preferably extends through both the body portion 22 and the top flange portion 24 for the entire longitudinal length of the extruded plastic strip 20 so that the plastic strip 20 takes on the appearance of the metallic strip 32. For example, if the metallic strip 32 has a silver metallic-like finish, then the plastic strip 20 would have a metal silver-like appearance, such as normally found on automobiles and appliances. On the other hand, if the metallic strip 32 has a wood grain-like finish, then the plastic strip 20 would have the appearance of wood, such as normally used to decorate the interior of automobiles.

Accordingly, the metallic strip 32 can be made in any color or texture as desired to provide the plastic strip 20 with a particular decorative appearance. Preferably, the metallic strip 32 is fabricated from a metalized mylar or any other suitable material such as tin foil and the like, which is fed in during the extruding process, being well known in the art. If desired, the metallic strip 32 can be fabricated from a stiff rigid metal material to strengthen the body portion 22 and top flange portion 24 of the plastic strip 20.

Figure 5:
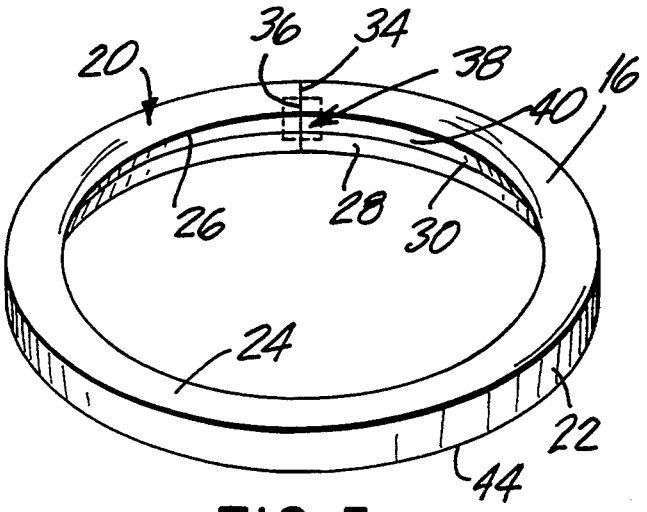
FIG. 5 is a perspective view of the endless edge trim formed from the extruded plastic strip, having a hoop or ring configuration.
Figure 6:
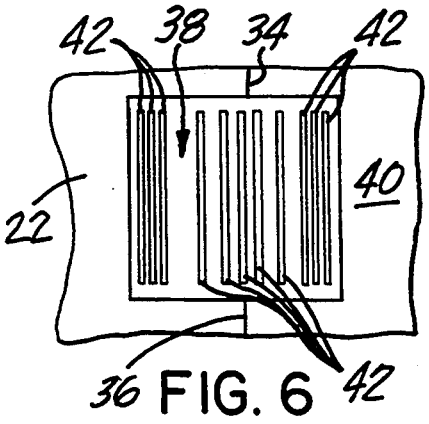
FIG. 6 is an enlarged fragmented side elevational view showing the sonically welded reinforcing gusset joining the opposite ends of the extruded plastic strip together to form the endless edge trim of FIG. 5.

After the plastic strip 20 has been extruded, the plastic strip 20 is transversely cut to a desired predetermined longitudinal length. As shown in FIG. 5, the opposite free ends 34, 36 of the cut plastic strip 20 are abutted against each other to form an endless construction, such as a hoop or ring construction. A gusset 38, preferably also fabricated from a thermoplastic material, is secured to the abutting end portions, preferably to the inner or unexposed surface 40 of the body portion 22, as shown in FIG. 6, by a chemical, mechanical or thermal securement to complete the hoop or ring configuration. Preferably, the guggest 38 can be secured to the joint area of the plastic strip 20 at high speed in the production assembly line, with the utilization of a sonic welding process which melts the plastic gusset 38 and forms weld lines 42 there along to fixedly secure the gusset 38 to the inner surface 40 of the body portion 22 to thus form the endless edge trim 16, as shown in FIG. 5.

It is noted, that due to the flexibility of the hoop or ring configuration of the endless edge trim 16, the endless edge trim 16 can be locked onto the peripheral edge of any round or oval shaped article. Furthermore, the flexibility thereof also permits the endless edge trim 16 to be locked onto the peripheral edge of articles having continuous convex and concave curvatures, being limited in some cases by the degree of curvatures of the article's irregularly curved peripheral edge.

Figure 7:
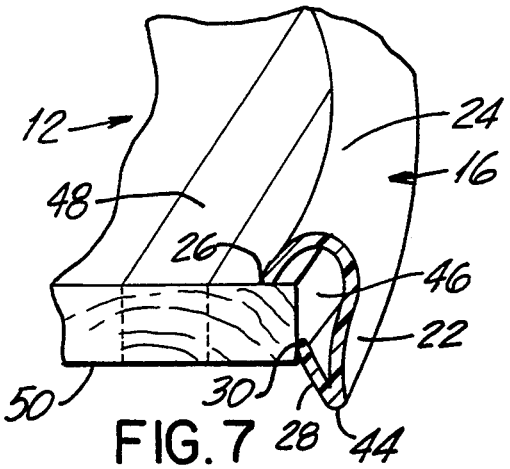
FIG. 7 is a fragmented perspective view showing the endless edge trim being inserted onto the round table top.

The endless edge trim 16 is now ready to be snapped and locked onto the peripheral edge of the round table top 12, which, by way of example, can be made in an easy and quick installation thereof without any need of adhesives, staples or other means of attachment. Accordingly, the endless edge trim 16 is placed around the table top 12 so that the bottom edge 44 thereof is positioned adjacent to the peripheral edge 46 of the table top 12. Thereafter, the endless edge trim 16 is pushed downwardly towards the upper surface 48 of the table top 12 so that the bottom edge portion 44 acts as a pilot and slides over the peripheral edge 46 of the table top 12. As the endless edge trim 16 is continued to be pushed downwardly during the snap-on engagement thereof, the bottom flange portion 28 thereof will slide against the peripheral edge 46 until the end 30 of the bottom flange portion 28 engages the peripheral edge 46, as shown in FIG. 7.

Figure 8:
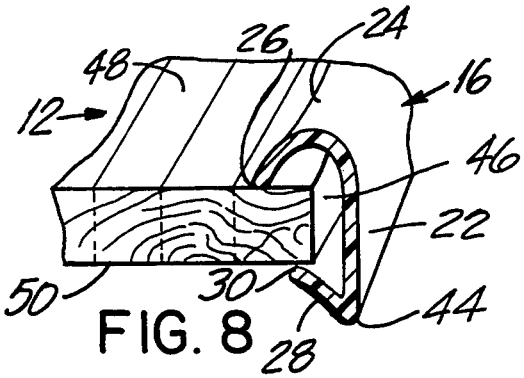
FIG. 8 is a fragmented perspective view similar to FIG. 7, showing the endless edge trim inserted on the round table top.

Continued downward pushing of the endless edge trim 16 will cause the end 30 of the bottom flange portion 28 to disengage from the peripheral edge 46 and snap back to a locking position against the undersurface 50 of the round table 12, as shown in FIG. 8, so that the body portion 22 covers the peripheral edge 46. Thus, due to the predetermined vertical distance between the end 26 of the top flange portion 24 and the end 30 of the bottom flange portion 28, which is less than the width of the peripheral edge 46, the bottom flange portion 28 is bent away from the body portion 22 so that a tension is provided to lock the table top 12 between the top and bottom flange portions 24, 28. In some cases, the plastic material of the endless edge trim 16 may not be flexible enough for the bottom flange portion 28 to resiliently function in the above manner. Therefore, in such a case, preferably only the bottom flange portion 28 would be formed from another material of low durometer, as mentioned above.

Figure 9:
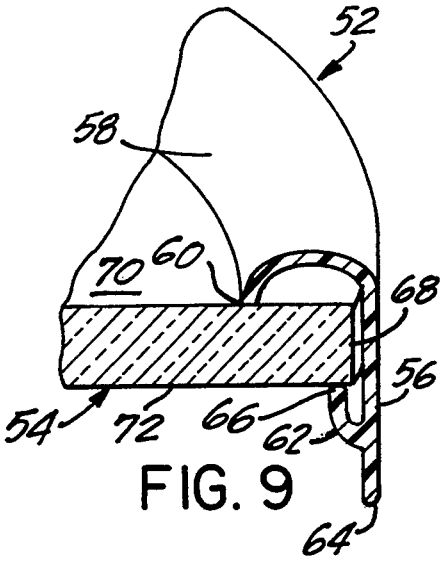
FIG. 9 is a fragmented perspective view similar to FIG. 8, showing a modified endless edge trim inserted on a round or oval article.

FIG. 9 shows a modified endless edge trim 52 mounted on a round or oval article 54. The endless edge trim 52, for the most part, is constructed in the same way and functions in the same manner as the above mentioned endless edge trim 16, however, the endless edge trim 52 can be initially seated on the round or oval article 54 prior to being pushed down thereon. Accordingly, the endless edge trim 52 is constructed from a continuous extruded profile of thermoplastic material having a "L" shape with a uniform cross section. The resilient flexible plastic profile includes a longitudinally extending vertical body portion 56, which is preferably wider vertically than the above-mentioned body portion 22. An arcuate inwardly curved longitudinally extending top flange portion 58 having a downwardly extending free end 60, similar to the above-mentioned top flange portion 24, is connected to the longitudinally extending upper end of the body portion 56. A longitudinally extending bottom flange portion or rib 62 extends in an upward direction from the body portion 56, the rib 62 being spaced from the free end 64 of the body portion 56. The upper part of the rib 62 is spaced from and parallel to the body portion 56. Here again, the vertical distance between the end 60 of the top flange portion 58 and the free end 66 of the rib 62 is predetermined. It is noted, though not shown, that the gusset 38 is used to secure the opposite abutted ends of the body portion 56 of the endless edge trim 52 together, in the same manner as mentioned above.

Accordingly, when the endless edge trim 52 is placed around the edge of the article 54, the inner surface of the lower part of the body portion 56, which is disposed between the rib 62 and the free end 64, is positioned against the peripheral edge 68 of the article 54 so that the lower part of the body portion 56 overhangs the peripheral edge 68 of the article 54 to seat the endless edge trim 52 thereon in a secure arrangement. Thereafter, the endless edge trim 52 is pushed downwardly towards the upper surface 70 of the article, and is snapped and locked onto the peripheral edge 68 of the article 54 in the same manner as mentioned above.

However, as shown in FIG. 9, the vertical distance between the free end 60 of the top flange portion 58 and the free end 66 of the rib 62 is approximately equal to or slightly less than the width of the peripheral edge 68. Therefore, the free end 66 of the bottom flange portion or rib 62, under tension, abuts against the undersurface 72 of the article 54 for the lock-on engagement of the endless edge trim 52, rather than being bent in the manner mentioned above with respect to the bottom flange portion 28. Accordingly, in this embodiment, the tension can be provided by the top flange portion 58 which is caused to slightly bow outwardly under tension when the free end 66 of the rib 62 is snapped into engagement with the under surface 72 of the article 54.

As mentioned above, the endless edge trims 16, 52 are constructed to snap-on and lock onto the peripheral edge of any round or oval shaped article and irregularly curved peripheral edges. Accordingly, endless edge trims for rectangular, including square, shaped articles, as well as articles having straight edges, will be discussed below.

Figure 10:
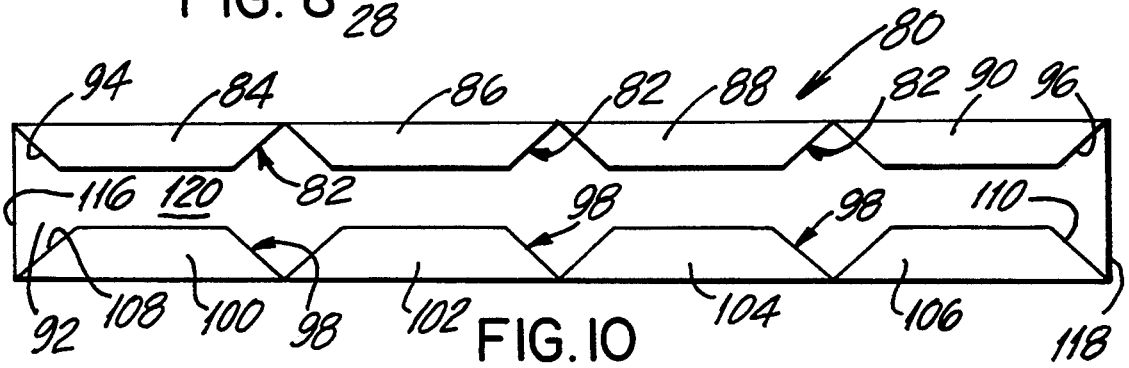
FIG. 10 is a side elevational view showing a modified extruded plastic strip notched at preselected intervals.

FIG. 10 shows a modified plastic strip 80 which is formed from the above mentioned plastic strip 20 shown in FIGS. 2–4, to provide an extruded profile of thermoplastic material having a "J" or "L" shape with a uniform cross section. Accordingly, the above mentioned plastic strip 20 is transversely cut to provide a predetermined longitudinal length for extending around the periphery of a square or rectangular shaped article. The arcuate inwardly curved longitudinally extending top flange portion 24 of the plastic strip 20 is notched at predetermined intervals in a predetermined manner by a special commercially available tool (not shown) to form three longitudinally spaced apart notches 82 therethrough, thus providing a series of four longitudinally spaced apart arcuately inwardly curved upper flange portions 84, 86, 88 and 90, each of which being connected to the longitudinally extending body portion 92 of the plastic strip 80. Additionally, preferably in the same operation, the above mentioned tool cuts the free end of the top flange portion 84 to provide an inclined leading edge 94, and also cuts the free end of the top flange portion 90 to provide an inclined trailing edge 96.

In a like manner, the above mentioned tool notches the inwardly inclined, longitudinally extending bottom flange portion 28 of the plastic strip 20 at predetermined intervals in the same predetermined manner to form three longitudinally spaced apart notches 98 therethrough, thus providing a series of four longitudinally spaced apart inwardly inclined bottom flange portions 100, 102, 104 and 106, each of which is connected to the longitudinally extending body portion 92 of the plastic strip 80. Additionally, in the same operation, the above mentioned tool cuts the free end of the bottom flange portion 100 to provide an inclined leading edge 108, and also cuts the free end of the bottom flange portion 106 to provide an inclined trailing edge 110.

Figure 11:
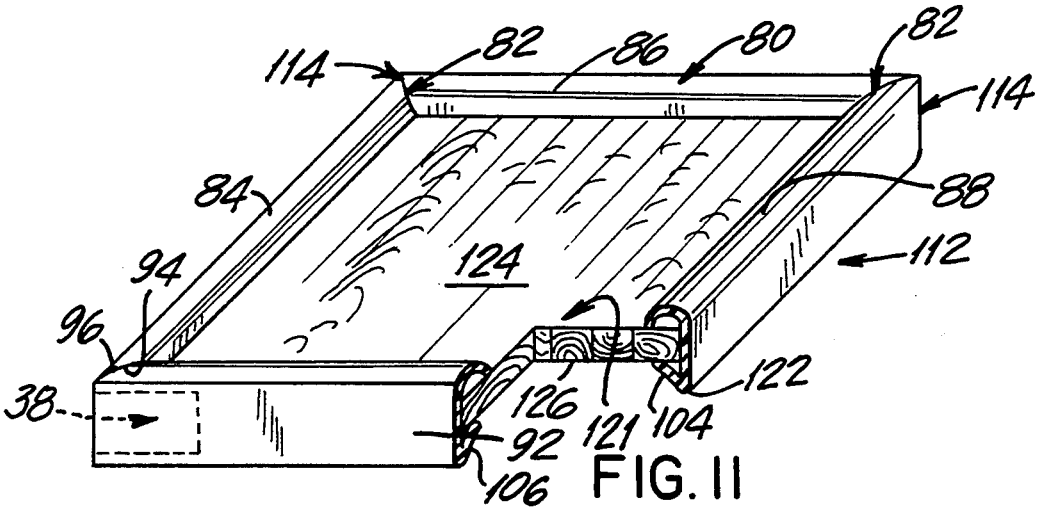
FIG. 11 is a perspective view, with a portion cut out, showing a square or rectangular edge trim, formed from the extruded plastic strip of FIG. 10, locked onto the edges of a square or rectangular article.

It is noted, that in order to provide a square edge trim 112, as shown in FIG. 11, each of the top flange portions 84, 86, 88, 90 and each of the bottom flange portions 100, 102, 104, 106, respectively, are transversely aligned and have the same longitudinal length. Obviously, if a rectangular edge trim is desired, then the top flange portions 84, 88 and the bottom flange portions 100, 104 would have the same first longitudinal length, and the other top flange portions 86, 90 and bottom flange portions 102, 106 would have the same second longitudinal length, the first longitudinal length being different from the second longitudinal length, either longer or shorter as desired. Furthermore, the edges of the notches 82 and 98 are at right angles to each other so that when the transverse portion of the body portion 92 disposed vertically between associated ones of the notches 82, 98, is bent, square shaped corners 114 are formed as shown in FIG. 11.

After the above mentioned notching, the plastic strip 80 is now transversely bent at each of the three pairs of associated notches 82, 98, so that the leading edges 94, 108 of the top and bottom flange portions 84, 100, respectively, abut against the trailing edges 96, 110 of the top and bottom flange portions 90, 106, respectively, and the opposite ends 116 and 118 of the plastic strip 80 abut against each other to form a square-shaped construction, as indicated in FIG. 11. In the same manner as indicated above, the gusset 38 is secured to the abuting end portions of the square-shaped edge trim 112, preferably to the inner or unexposed surface 120 (shown in FIG. 10) of the body portion 92, as indicated in FIG. 11, by a chemical, mechanical or thermal securement, such as by a sonic weld as indicated above. Once the gusset 38 is fixedly secured to the inner surface 120 of the body portion 92, the endless edge trim 112 is formed, the endless edge trim 112 having a square-shaped configuration as shown in FIG. 11.

The endless edge trim 112 is now ready to be snapped and locked onto the peripheral edge of a square-shaped article 121, as shown in FIG. 11 by way of example, which can be made in an easy and quick installation thereof, in the same manner set forth above with respect to the endless edge trim 16, without any need of adhesives, staples or other means of attachment. Accordingly, the endless edge trim 112 is placed around the top of the article 121 so that the bottom edge portion 122 of the endless edge trim 112 is positioned adjacent to the peripheral edge of the square-shaped article 121. Thereafter, the endless edge trim 112 is pushed downwardly towards the upper surface 124 of the square-shaped article 121 so that the bottom edge portion 122 acts as a pilot and slides over the peripheral edge of the square-shaped article 121. As the endless edge trim 112 is continued to be pushed downwardly, the bottom flange portions 100, 102, 104, 106 thereof will slide against the peripheral edge of the square-shaped article 121 until the free ends thereof engage the peripheral edge of the square-shaped article 121, similar to the showing in FIG. 7.

Continued downward pushing of the endless edge trim 112 will cause the free ends of the bottom flange portions 100, 102, 104, 106 to disengage from the peripheral edge of the square-shaped article 121 and snap back to a locking position against the undersurface 126 of the square-shaped article 121, as shown in FIG. 11, in a similar manner as the showing of FIG. 8. Thus, due to the predetermined vertical distance between free ends of the top flange portions 84, 86, 88, 90 and the free ends of the bottom flange portions 100, 102, 104, 106, which is less than the width of the peripheral edge of the square-shaped article 121, the bottom flange portions 100, 102, 104, 106 are bent away from the body portion 92 so that a tension is provided to lock the square-shaped article 121 between the top and bottom flange portions.

As indicated above, in some cases, the plastic material of the endless edge trim 112 may not be flexible enough for the bottom flange portions 100, 102, 104, 106 to resiliently function in the above manner. Therefore, in such a case, preferably only the bottom flange portions 100, 102, 104, 106 would be formed from another material of low durometer, as mentioned above. Obviously, an endless edge trim having a rectangular shape would be installed onto a rectangular shaped article in the same manner as indicated above. In a like manner, an endless edge trim can be provided for articles having both curved and straight edges.

Obviously, the above mentioned endless edge trim 52, shown in FIG. 9, can also be notched in the above manner for snapping and locking onto a rectangular, including square, shaped article. Accordingly, a detailed description thereof is not thought necessary for one of ordinary skill in the art, particularly where the procedure therefor would be the same as set forth above.

Numerous alterations of the structure herein discussed will suggest themselves to those skilled in the art. However, it is to be understood that the present disclosure relates to preferred embodiments of the invention which are for the purpose of illustration only, and are not to be construed as limitations of the invention.

What is claimed is:

1. An edge trim for mounting on a peripheral edge of an article, comprising:

a longitudinally extending body member fabricated from an extruded profile, said body member having a predetermined length;

securement means for securing abutted opposite ends of said body member together to provide an endless construction;

said body member including a vertical body portion for covering the peripheral edge of the article, and a top flange portion connected to an upper end of said body portion for engaging a top surface portion of the article disposed adjacent to the peripheral edge;

a lower portion of said body portion being provided with pilot means for sliding vertically downwardly against the peripheral edge of the article to position said body portion around the peripheral edge of the article;

resilient flexible means being guided by said pilot means into a vertically downwardly sliding engagement against the peripheral edge of the article for snapping onto the peripheral edge of the article and engaging a bottom surface portion of the article disposed adjacent to the peripheral edge;

said resilient flexible means being connected to said body portion, said resilient flexible means being disposed above said pilot means and spaced below said top flange portion; and said resilient flexible means and said top flange portion being spaced apart a predetermined distance to provide a tension therebetween when disposed on the article for locking said edge trim on the peripheral edge of the article in a secure engagement.

2. An edge trim according to claim 1, wherein said securement means is a sonic welded gusset secured to inner surfaces of said body portion adjacent to said abutted opposite ends of said body member, said sonic welded gusset extending across said abutted opposite ends.

3. An edge trim according to claim 1, wherein said resilient flexible means includes a bottom flange portion extending upwardly from said body portion in a direction towards said top flange portion, said top and bottom flange portions both extending inwardly from one side of said body portion.

4. An edge trim according to claim 3, wherein said endless construction is hoop or ring shaped.

5. An edge trim according to claim 3, wherein said top and bottom flange portions are notched at predetermined intervals so that said endless construction is rectangularly shaped.

6. An edge trim according to claim 3, wherein said bottom flange portion is connected to a lower end of said body portion.

7. An edge trim according to claim 6, wherein said bottom flange portion extends upwardly from said lower end of said body portion and is inclined inwardly with respect to said one side of said body portion.

8. An edge trim according to claim 3, wherein said bottom flange portion is connected to an inner surface of said body portion.

9. An edge trim according to claim 8, wherein said bottom flange portion extends vertically upwardly so that an upper part of said bottom flange portion is spaced parallel to said body portion.

10. An edge trim according to claim 8, wherein a free lower end of said body portion is positioned below said bottom flange portion to provide a seat for positioning said endless construction on the article.

11. An edge trim according to claim 1, wherein said body member includes seat means for positioning said endless construction on the article.

12. An edge trim according to claim 1, wherein said top flange portion is arcuately curved inwardly from said body portion so that a free end of said top flange portion engages the top surface portion of the article adjacent to the peripheral edge.

13. An edge trim according to claim 1, wherein said body member has a uniform cross section.

14. An edge trim according to claim 1, wherein said body member is fabricated from a resilient flexible material.

15. An edge trim according to claim 14, wherein said resilient flexible material is thermoplastic.

16. An edge trim according to claim 6, wherein said pilot means includes said lower end of said body portion.

17. An edge trim according to claim 10, wherein said pilot means includes said free lower end of said body portion.

18. An edge trim for mounting on a peripheral edge of an article comprising:

a longitudinally extending body member fabricated from an extruded profile, said body member having a predetermined length;

securement means for securing abutted opposite ends of said body member together to provide an endless construction;

said body member including a vertical body portion for covering the peripheral edge of the article, and a top flange portion connected to an upper end of said body portion for engaging a top surface portion of the article disposed adjacent to the peripheral edge;

resilient flexible means connected to said body portion and spaced below said top flange portion for snapping onto the peripheral edge of the article and engaging a bottom surface portion of the article disposed adjacent to the peripheral edge;

said resilient flexible means and said top flange portion being spaced apart a predetermined distance to provide a tension therebetween when disposed on the article for locking said edge trim on the peripheral edge of the article in a secure engagement;

said resilient flexible means including a bottom flange portion extending upwardly from said body portion in a direction towards said top flange portion, said top and bottom flange portions both extending inwardly from one side of said body portion; and said bottom flange portion being connected to an inner surface of said body portion.

19. An edge trim according to claim 18, wherein said bottom flange portion extends vertically upwardly so that an upper part of said bottom flange portion is spaced parallel to said body portion.

20. An edge trim according to claim 18, wherein a free lower end of said body portion is positioned below said bottom flange portion to provide a seat for positioning said endless construction on the article.

* * * * *